US007770930B2

(12) United States Patent
McLeod

(10) Patent No.: US 7,770,930 B2
(45) Date of Patent: Aug. 10, 2010

(54) EXERCISE WEIGHT FOR ICE SKATES

(76) Inventor: Donald Allen McLeod, 790 Valley View Drive, RR 3, Powassan, Ontario (CA) P0H 1Z0

( * ) Notice: Subject to any disclaimer, the term of this patent is extended or adjusted under 35 U.S.C. 154(b) by 153 days.

(21) Appl. No.: 11/726,584

(22) Filed: Mar. 22, 2007

(65) Prior Publication Data

US 2007/0222203 A1 Sep. 27, 2007

(30) Foreign Application Priority Data

Mar. 23, 2006 (CA) ..... 2540898

(51) Int. Cl.
*A63C 11/00* (2006.01)

(52) U.S. Cl. ..... 280/809; 280/841; 280/11.12

(58) Field of Classification Search ..... 280/11.18, 280/11.17, 7.13, 11.231, 11.221, 809, 811, 280/816, 11.12, 841; 482/105, 51, 79, 93, 482/94

See application file for complete search history.

(56) References Cited

U.S. PATENT DOCUMENTS 2,764,417 A * 9/1956 Sweet ..... 280/11.12
3,026,119 A * 3/1962 Bauer ..... 280/11.18
3,582,067 A * 6/1971 Rucks ..... 280/816
3,870,328 A * 3/1975 Gemmel et al. ..... 280/809
3,901,524 A * 8/1975 Ouellette ..... 280/809
4,492,385 A * 1/1985 Olson ..... 280/7.13
5,234,230 A * 8/1993 Crane et al. ..... 280/811
5,257,793 A * 11/1993 Fortin ..... 280/7.13
5,743,564 A * 4/1998 Aarnio et al. ..... 280/811
5,769,434 A * 6/1998 Wurthner ..... 280/11.18
5,876,044 A * 3/1999 Yin ..... 280/11.231
6,105,975 A * 8/2000 Shum ..... 280/7.13
6,341,785 B1 * 1/2002 Benoit ..... 280/11.221
6,485,033 B2 * 11/2002 Nicoletti et al. ..... 280/11.18
6,623,017 B1 * 9/2003 Steinhauser, Jr. ..... 280/11.18
6,957,830 B1 * 10/2005 Goodman ..... 280/809
7,063,650 B1 * 6/2006 Beausoleil ..... 482/105
7,243,924 B2 * 7/2007 Dahlo et al. ..... 280/11.18

FOREIGN PATENT DOCUMENTS

CA 982623 1/1976

* cited by examiner

*Primary Examiner*—Hau V Phan
(74) *Attorney, Agent, or Firm*—Conley Rose, P.C.

(57) ABSTRACT

An exercise weight for a skate comprising a pair of similar elongated weight pieces. The skate comprises a boot, an elongated blade holder having spaced posts and a runner. The blade holder is secured to an underside of the boot and the runner is secured to blade holder. The weight is configured to be cooperatively releasably attached to the blade holder in a manner such that the weight pieces mateably conform to and engage with opposed side portions of the spaced posts below the boot and above the runner.

11 Claims, 2 Drawing Sheets

EXERCISE WEIGHT FOR ICE SKATES

CROSS-REFERENCE TO RELATED APPLICATION

The present application claims priority to Canadian Patent Application No. 2,540,898 filed Mar. 23, 2006, hereby incorporated herein by reference.

STATEMENT REGARDING FEDERALLY SPONSORED RESEARCH OR DEVELOPMENT

Not Applicable.

FIELD OF THE INVENTION

The present invention relates to exercise weights for ice skates.

BACKGROUND OF THE INVENTION

Recent developments in ice skate technology have included changes to skate constructions, such as the development of moulded blade supports (such as the Tuuk™ blade support construction for hockey skates. In addition, the demands on athletes in various sports involving ice skates, such as hockey, figure skating and speed skating has precipitated a need for more rigorous training, such as training with exercise weights to strengthen leg, ankle and foot muscles and improve skating technique.

U.S. Pat. No. 3,870,328 (Gemmel et al.) discloses an exercise weight for an ice skate. This weight attaches to an old-style hockey skate by clamping onto the blade holder via a semi-cylindrical bore. The weight is constructed from two portions which are held together by a wing nut and a bolt. The weight is relatively small, thus localizing the weight in a central portion of the skate. This type of weight construction would not be suitable for attachment to modern blade supports.

Canadian Patent No. 982,623 also discloses an exercise weight for an ice skate. This comprises a block and a spring-mounted leg which projects from the block. This weight fits tightly between the two spaced posts of the blade holder of an old-style hockey skate. Again, this weight localizes the weight in a central portion of the skate and would not be suitable for attachment to modern blade supports.

Thus, there exists a need for an exercise weight adapted for an ice skate that does not localize the additional weight in a particular portion of the skate. Further, there exists a need for an exercise weight adapted for an ice skate which is suitable for modern blade support constructions.

SUMMARY OF THE INVENTION

In accordance with an aspect of the invention there is provided an exercise weight for a skate. The skate comprises a boot, an elongate blade holder having spaced posts, the blade holder secured to an underside of the boot, and a runner secured to the blade holder. The weight comprises a pair of similar elongate weight pieces configured to be cooperatively releasably attached to the blade holder in a manner such that the weight pieces mateably conform to and surround opposed side portions of the spaced posts of the blade holder below the boot and above the runner and wherein the weight pieces, when in position attached to and surrounding the blade holder, extend substantially the entire length of the runner below the boot and locking means comprising a back strap secured to and extending between the respective rear portions of each weight piece of the pair and a front strap secured to and extending between the respective front parts of each weight piece of the pair for releasably attaching one weight piece of the pair to the other weight piece of the pair.

In accordance with another aspect of the invention there is provided a skate with a releasably attachable training weight. The skate comprises a boot, an elongate blade holder having spaced posts, the blade holder secured to an underside of the boot, and a runner secured to the blade holder. The skate further comprises a pair of similar elongated weight pieces configured to be cooperatively releasably attached to the holder in a manner such that the weight pieces mateably conform to and surround opposed side portions of the spaced posts of the blade holder below the boot and above the runner and wherein the weight pieces, when in position attached to and surrounding the blade holder, extend substantially the entire length of the runner below the boot and locking means comprising a back strap secured to and extending between the respective rear portions of each weight piece of the pair and a front strap secured to and extending between the respective front portions of each weight piece of the pair for releasably attaching one weight piece of the pair to the other weight piece of the pair.

This weight arrangement is suitable for attachment to modern blade support constructions, such as Tuuk™ blade supports. Further, this weight arrangement distributes weight evenly along the length of the skate.

BRIEF DESCRIPTION OF THE DRAWINGS

These and other advantages of the invention will become apparent upon reading the following detailed description and upon referring to the drawings in which.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figure 1:
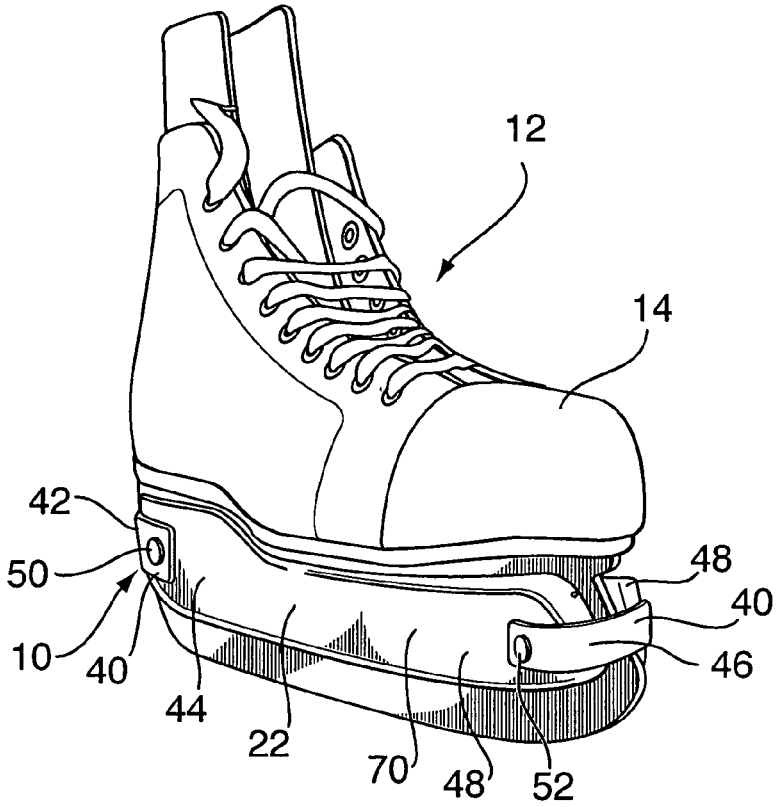
FIG. 1 is a perspective view from the side and front of an embodiment of an exercise weight and ice skate in accordance with the invention.
Figure 2:
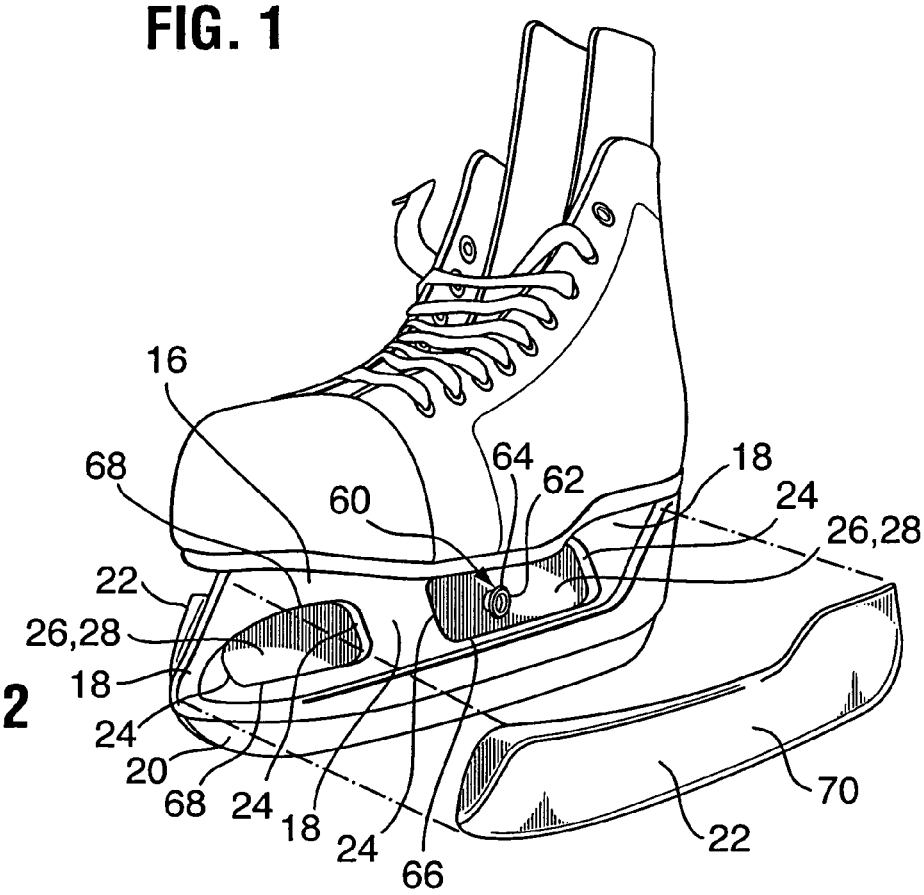
FIG. 2 is a perspective view from the side and front of an embodiment of an exercise weight and ice skate in accordance with the invention.

FIGS. 1 and 2 illustrate an exercise weight 10 for an ice skate 12. The skate 12 has a boot 14, an elongated blade holder 16 having spaced posts 18 and a blade or runner 20 secured to blade holder 16. The blade holder is secured to an underside of the boot.

Figure 3:
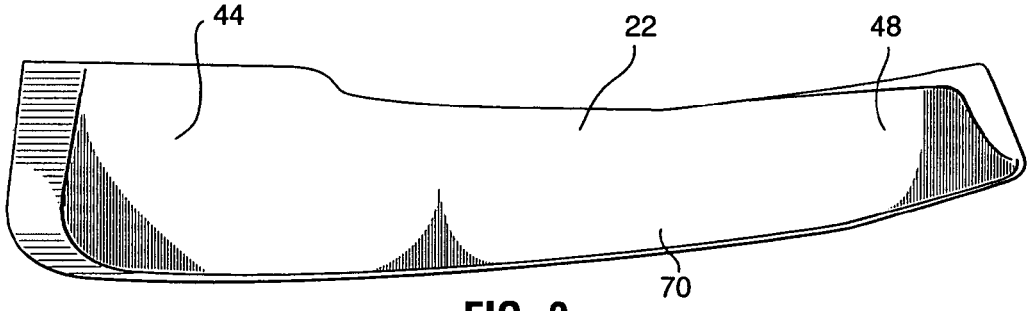
FIG. 3 is an exterior side view of a weight piece in accordance with the invention.
Figure 4:
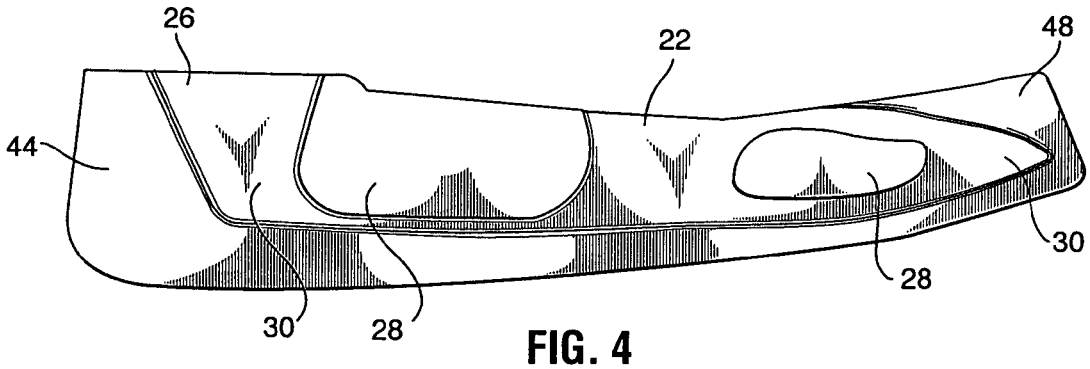
FIG. 4 is an interior side view of a weight piece in accordance with the invention.

The exercise weight 10 comprises a pair of similar elongated weight pieces 22. These weight pieces 22 are shown in detail in FIGS. 3 and 4. The weight pieces 22 are configured to be cooperatively releasably attached to the blade holder 16. When attached to the blade holder 16, the weight pieces 22 mateably conform to and engage with opposed side portions 24 of the spaced posts below the boot 14 and above the runner 20, as shown. As shown in detail in FIG. 4, the inner surfaces of the weight pieces 26 are provided with confronting faces 28 and depressions 30 formed to mate with and receive portions of the blade holder.

As illustrated in FIG. 1, the pair of weight pieces 22 may be provided with locking means 40 for releasably attaching one weight piece 22 of the pair to the other weight piece 22 of the pair. The locking means 40 may comprise a back strap 42 secured to and extending between the respective rear portions 44 of each weight piece 22 of the pair and a front strap 46 secured to and extending between the respective front portions 48 of each weight piece 22 of the pair.

The back strap 42 is releasably secured to at least one of the rear portions 44 of the weight pieces 22 of the pair by a fastener 50. Alternatively or additionally, the front strap 46 is releasably secured to at least one of the front portions 48 of the weight pieces 22 of the pair by a similar fastener 52. The fasteners 50 and 52 may be a snap button or a hook and loop fastener such as Velcro™. Of course, the skilled person would understand that any suitable fastener could be used.

The back strap 42 and the front strap 46 may be made of any suitable material, such as woven polyester or cotton. Alternatively, the back strap 42 and the front strap 46 may be made of flexible plastic or metal.

FIG. 2 illustrates alternative locking means 60 for releasably attaching one weight piece 22 of the pair to the other weight piece 22 of the pair. Here, the locking means 60 comprises a two-part clasp 62. Each part 64 of the two-part clasp 62 is disposed on a respective confronting inner surface 26, specifically a confronting face 28, of each weight piece 22 of the pair in general alignment with an opening 66 defined between the spaced posts 18 of the blade holder 16 and the boot 14. Alternatively, each part 64 of the two-part clasp 62 could be disposed in general alignment with another opening 68 defined between the spaced posts 18 of the blade holder 16 and the boot 14. Of course, more than one two-part clasp 62 could be implemented. Additional two-part clasps 62 could also be aligned with the opening 66 or with the other opening 68 or both.

The two-part clasp 62 may be one of a snap button and a hook and loop fastener such as Velcro™. Of course, the skilled person would understand that any suitable two-part clasp 62 or other type of fastener could be used.

As shown in FIGS. 1 and 2, the weight pieces 22 may be mirror images of each other. Of course, the weight pieces 22 could have different shapes.

As is also shown in the Figures, each weight piece 22 of the pair has a streamlined outer surface 70, i.e. an outer surface 70 which is contoured to reduce resistance to movement though a fluid. This ensures that the weight 10 does not interfere with normal skating movements. This also ensures that the ice skate 12 with the weight 10 attached to it is aerodynamic and will not collect ice scrapings.

The weight pieces 22, when in position attached to the blade holder 16, extend the length of the runner 20 below the boot 14. As such, there is substantially even weight distribution along the length of the ice skate 12.

The weight pieces 22 may be made of any suitable material. For example, the weight pieces 22 could be metal, or hollow plastic filled with a granular material (such as sand).

While the above described embodiments of the invention have been applied to ice skates, it should be understood that an exercise weight in accordance with the invention could also be applied to roller skates, inline skates and the like.

It is apparent that there has been provided in accordance with the invention an exercise weight for ice skates that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. An exercise weight for a skate, the skate comprising a boot, an elongate blade holder having spaced posts, the blade holder secured to an underside of the boot, and a runner secured to the blade holder, the weight comprising a pair of similar elongate weight pieces configured to be cooperatively releasably attached to the blade holder in a manner such that the weight pieces mateably conform to and surround opposed side portions of the spaced posts of the blade holder below the boot and above the runner and wherein the weight pieces, when in position attached to and surrounding the blade holder, extend substantially the entire length of the runner below the boot and locking means comprising a back strap secured to and extending between the respective rear portions of each weight piece of the pair and a front strap secured to and extending between the respective front parts of each weight piece of the pair for releasably attaching one weight piece of the pair to the other weight piece of the pair.

2. An exercise weight according to claim 1, wherein the weight pieces are mirror images of each other and the inner surfaces of the weight pieces are provided with confronting faces and depressions formed to mate with and receive portions of the blade holder.

3. An exercise weight according to claim 1, wherein the back strap is releasably secured to at least one of the rear portions of the weight pieces of the pair by a fastener.

4. An exercise weight according to claim 3, wherein the fastener is one of a snap button and a hook and loop fastener.

5. An exercise weight according to claim 1, wherein the front strap is releasably secured to at least one of the front portions of the weight pieces of the pair by a fastener.

6. An exercise weight according to claim 5, wherein the fastener is one of a snap button and a hook and loop fastener.

7. An exercise weight according to claim 1, wherein the locking means comprises at least one two-part clasp, each part of the at least one two-part clasp being disposed on a respective inner surface of each weight piece of the pair in general alignment with at least one opening defined between the spaced posts of the blade holder and the boot.

8. An exercise weight according to claim 7, wherein the two-part clasp is one of a snap button and a hook and loop fastener.

9. An exercise weight according to claim 1, wherein each weight piece of the pair has a streamlined outer surface.

10. An exercise weight according to claim 1, wherein there is substantially even weight distribution along the length of each weight piece.

11. A skate with a releasably attachable training weight, the skate comprising:

a boot;

an elongate blade holder having spaced posts, the blade holder secured to an underside of the boot;

a runner secured to the blade holder;

a pair of similar elongate weight pieces configured to be cooperatively releasably attached to the holder in a manner such that the weight pieces mateably conform to and surround opposed side portions of the spaced posts of the blade holder below the boot and above the runner and wherein the weight pieces, when in position attached to and surrounding the blade holder, extend substantially the entire length of the runner below the boot; and locking means comprising a back strap secured to and extending between the respective rear portions of each weight piece of the pair and a front strap secured to and extending between the respective front portions of each weight piece of the pair for releasably attaching one weight piece of the pair to the other weight piece of the pair.

* * * * *